284812 0342 -00 02-19-91 45128 01-18-91 151501 78147.0 04993400 1070

United States Patent [19]

Fitzwater

[11] Patent Number: 4,993,400

[45] Date of Patent: Feb. 19, 1991

[54] PELLET FEED SYSTEM FOR AN AIR GUN

[76] Inventor: Edwin Fitzwater, 1370 Bryant St., Rahway, N.J. 07065

[21] Appl. No.: 392,546

[22] Filed: Aug. 11, 1989

[51] Int. Cl.[5] ..... F41B 11/00

[52] U.S. Cl. ..... 124/48; 124/51.1

[58] Field of Search ..... 124/63-68, 124/45, 48, 51 R, 56, 49, 50, 51.1, 52, 53

[56] References Cited

U.S. PATENT DOCUMENTS

| | | | |
|---|---|---|---|
| 926,546 | 6/1909 | Cox | 124/48 |
| 1,816,091 | 7/1931 | Schmeisser | 124/48 |
| 2,502,909 | 4/1950 | Wick et al. | 124/45 X |
| 3,547,095 | 12/1970 | Vadas | 124/48 X |
| 3,741,189 | 6/1973 | Kester et al. | 124/48 X |
| 3,818,887 | 6/1974 | Akiyama et al. | 124/67 |
| 3,913,553 | 10/1975 | Braughler et al. | 124/48 X |

FOREIGN PATENT DOCUMENTS

| | | | |
|---|---|---|---|
| 2053107 | 5/1973 | Fed. Rep. of Germany | 124/51 R |
| 685700 | 1/1953 | United Kingdom | 124/48 |

OTHER PUBLICATIONS

"Gas, Air and Spring Guns", W. H. B. Smith, 1957, pp. 146-147.

*Primary Examiner*—Randolph A. Reese
*Assistant Examiner*—Jeffrey L. Thompson
*Attorney, Agent, or Firm*—John F. Ohlandt

[57] ABSTRACT

A pellet feed system for an air gun, according to which a magazine is provided with a plurality of compartments dimensioned to permit the containment of pellets of various shapes; and including a pellet setting device operable in conjunction with said magazine for advancing the pellets singly from the magazine down into a loading cylinder so that the skirt of the pellet is sized by the force applied within the loading cylinder diameter. The operation just described can be performed in any normal position of the gun (not relying solely on gravity), and can even be operated in a gravity-free environment.

11 Claims, 3 Drawing Sheets

FIG.5
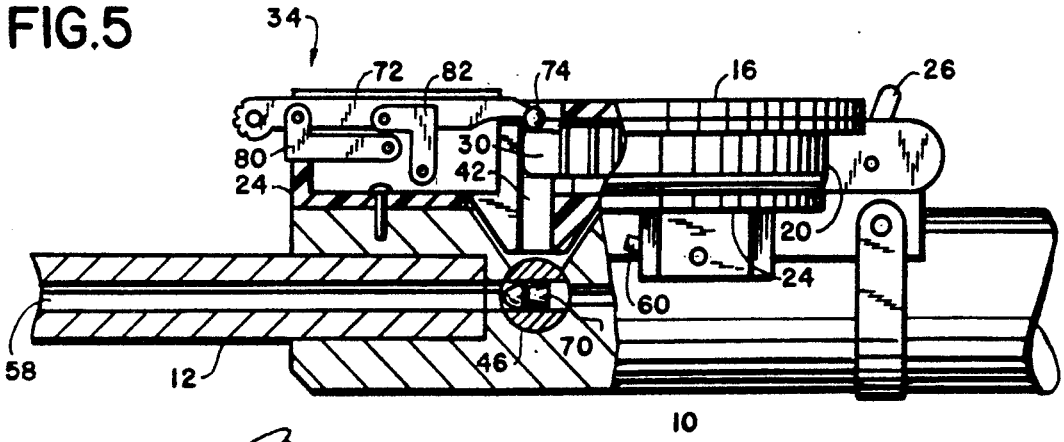
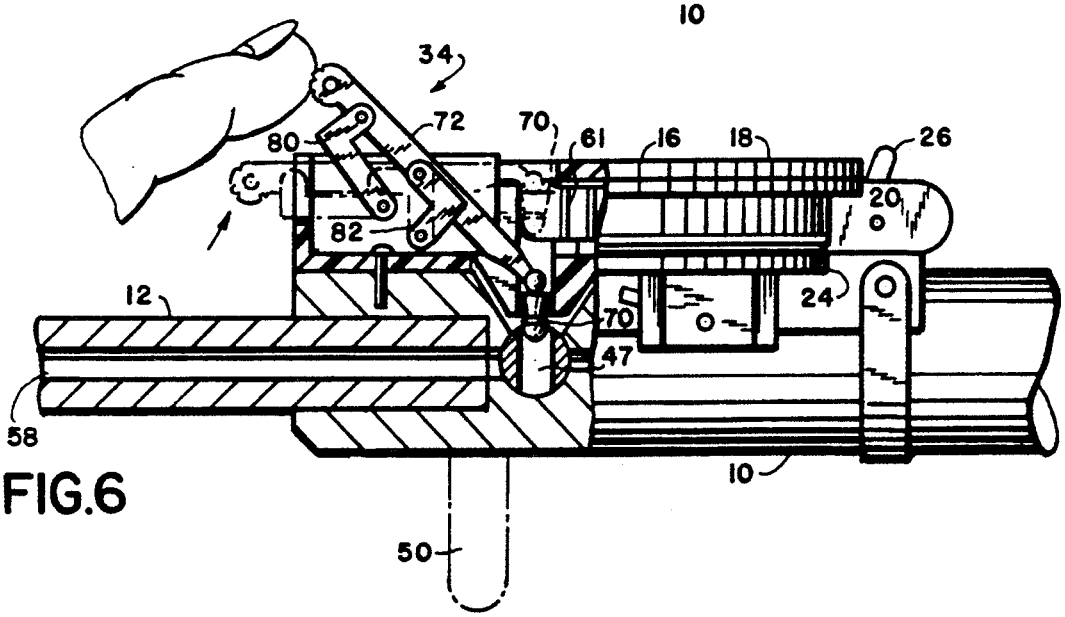
FIG.6
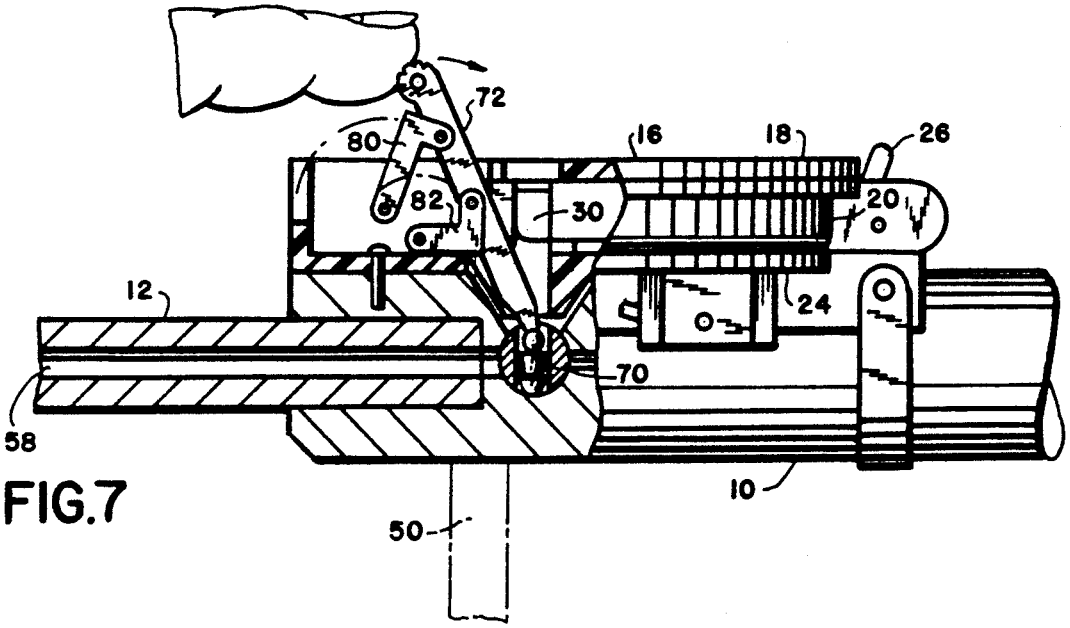
FIG.7

PELLET FEED SYSTEM FOR AN AIR GUN

BACKGROUND OF THE INVENTION

This invention relates to a pellet ieed system for an air gun or the like, and more particularly to a unique combination of a manually operated pellet setting device which cooperates with a removable cylindrical magazine.

The feed system of the present invention has been designed specifically for the type of air gun that has a loading tap hole on top and a cross-rotating loading cylinder which aligns the pellet into the barrel for shooting. This type of air gun contrasts with the break-and-open type (similar to a shotgun) which involves loading directly into the barrel.

BACKGROUND INFORMATION

It is known to the art of air guns that specially shaped soft lead or other material pellets with various nose configurations and rear skirt designs are far superior in obtaining accuracy and efficiency in the operation of the gun when compared to balls, that is, BBs, especially when used in conjunction with rifled bores, to impart rotation. However, because of the various shapes and somewhat fragile materials, the pellets are very difficult to load into air guns except one at a time. Accordingly, very few pellet feed systems known to me perform satisfactorily for a variety of reasons; in particular, because many are limited to one shape of pellet only, or they jam easily or misfire when the pellets become deformed.

Several examples of air guns having feed systems involving revolvable magazines can be appreciated by reference to U.S. Pat. Nos. 1,816,091 and 926,546. However, both of these references describe feed systems or arrangements that rely on gravity to effect the loading of a valve or the like with a given projectile, rather than the provision according to the present invention of insuring positive insertion of projectiles into a valve or loading cylinder.

SUMMARY OF THE INVENTION

It is therefore a primary object of the present invention to provide a pellet feed system that will operate satisfactorily for a variety of shapes of pellets and that will not jam when deformed pellets are encountered, and does not rely solely on gravity.

The above primary object is accomplished while achieving several notable advantages. The first advantage is a removable cylindrical magazine which is easily loaded with a plurality of pellets of any normal shape (of a given diameter) and easily secured to the magazine receiver, attached atop the gun. The second advantage is the easy indexing of a compartmented circular carousel within the magazine by means of a thumb-operated side lever working in conjunction with the magazine, which positions each new pellet directly over the loading hole for passage to the loading cylinder. Another advantage is that the magazine fits under the height requirements for gun sighting. In other words, it does not protrude vertically to a significant degree so as to interfere with the gun sighting.

The above and other objects are fulfilled by a pellet feed system comprising a manually operated pellet setting (sizing) device cooperating with a removable cylindrical magazine; an advancing feed mechanism rotates a pellet carousel or holder inside the magazine sequentially to position pellets directly over a loading hole, with the consequence that, regardless of the normal orientation of the air gun, the pellet setting device is operable to force each pellet into the cross-loading cylinder bore or opening, thereby sizing all pellet skirts, whether deformed or not. It will be appreciated that the positive insertion and sizing of each pellet into the feed or loading cylinder leads to more uniform and accurate projectile travel.

Briefly stated then, a primary feature of the present invention may be defined as a pellet feeding system for an air gun having a cross-loading cylinder, comprising: a cylindrical magazine removably attached to a receiver housing which in turn is permanently attached to said gun, said magazine having a plurality of compartments dimensioned to permit the containment of pellets having a variety of shapes; a pellet setting device, as part of the receiver housing, cooperating with said magazine to advance the pellets singly from the magazine down into said loading cylinder so that said skirt of said pellet is formed within the loading cylinder diameter.

A specific feature of the present invention resides in the fact that the pellet setting device is manually operable and positioned such that the operator's hand can be readily manipulated from a location where it is actuating a cam device for loading the gun to a location for causing the pellet setting device to perform its intended function. Furthermore, the pellet setting device is multiply-pivoted such that the operating arm of the device is actuatable by simple manipulation to cause its active ball-like end to execute a substantially straight line movement. As a consequence of such movement, the ball-like end acts forcefully on the pellet and to size the pellet that has been inserted into the rotatable feed cylinder.

Another broad feature of the present invention resides in an arrangement by which the magazine is retained on the gun by a moving latching mechanism, which is included on the magazine itself, engaging a rigid locking lug as part of the housing attached to the gun.

Other and further objects, advantages and features of the present invention will be understood by reference to the following specification in conjunction with the annexed drawing, wherein like parts have been given like numbers.

BRIEF DESCRIPTION OF THE DRAWING

FIG. 5 is another fragmentary view of the system of FIG. 1, showing the pellet setting device at rest before a pellet is transferred by the carousel to directly over the loading hole.

FIG. 6 is similar to FIG. 5, but after pellet is transferred to position over loading hole, rear of setting arm is raised, and the ball-like end travels down the loading hole, pushing or guiding the pellet.

FIG. 7 is similar to FIG. 6, but shows the pellet setting device finally pushing the pellet into the bore of the cross-loading cylinder and thereby sizing it to that diameter.

DESCRIPTION OF PREFERRED EMBODIMENT

Figure 1:
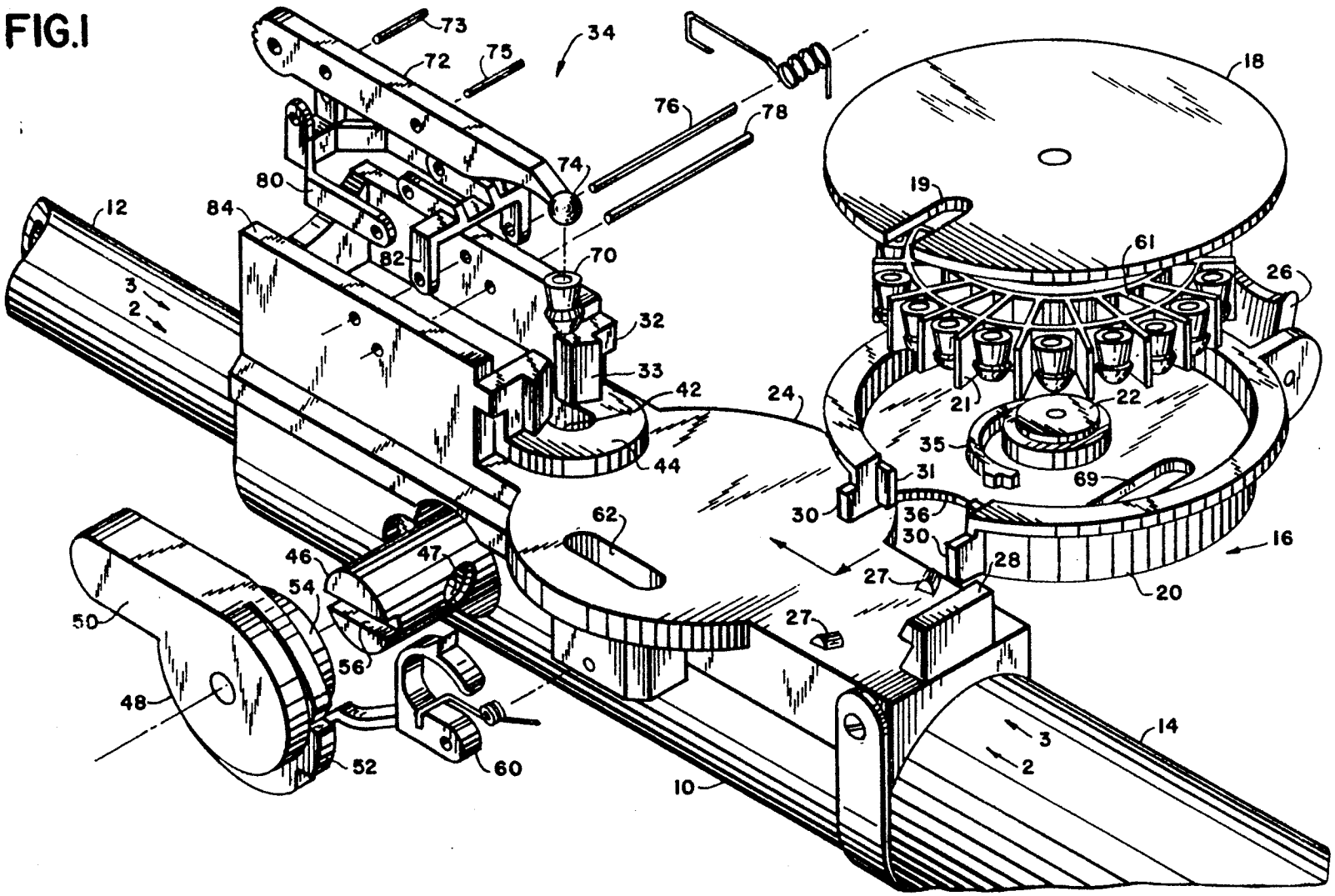
FIG. 1 is an exploded view of the pellet feeding system in accordance with a preferred embodiment of the present invention.
Figure 2:
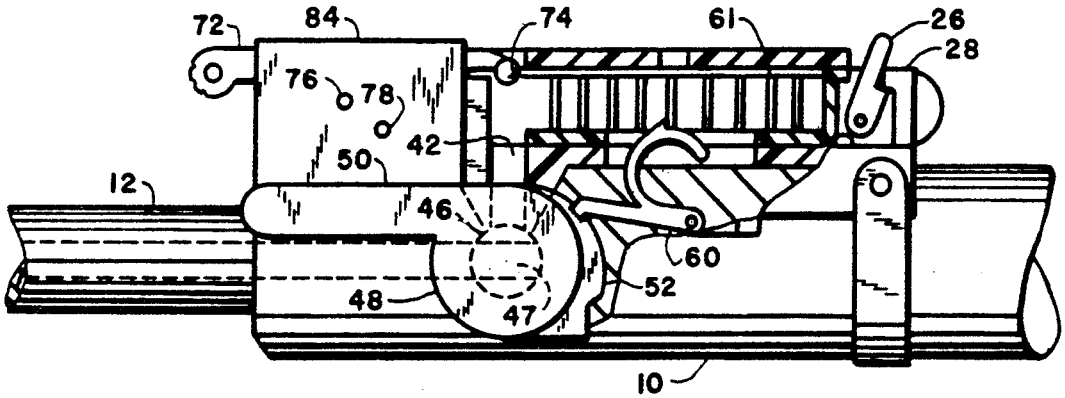
FIG. 2 is a fragmentary view of the system of FIG. 1, particularly showing the cam-lever and advancing finger in a first position corresponding with the pellet being in a firing position.

Referring now to the figures of the drawing, there will be seen a perspective exploded view of a pellet feed system for an air gun 10. At the upper end of FIG. 1 is the barrel 12 of the gun and at the rear, a cylindrical portion 14 forming a conventional air chamber enclosing an air plunger (not seen), as is typical in air guns as will be appreciated by reference to the previously cited U.S. Pat. No. 1,816,091.

It will be noted that a magazine 16, seen here as rotated 90 degrees from its normal operating position, comprises a top or cover 18, a magazine body 20, and a carousel 21 which is rotatable on a suitable boss 22 formed within the magazine body. An open slot 19 is provided in the cover to allow passage of the pellet setting arm 72.

A latching device 26 is mounted between two parallel walls on magazine body 20 (opposite side from loading), for purposes of securing the magazine 16 to a receiver housing 24. Cooperating with latching device 26 are guides 27 and a lug 28 integrally formed on the receiver housing to effectuate latching of the rear of the magazine when it has been turned from the position seen in FIG. 1 and pressed into a position 90 degrees clockwise therefrom. A pair of parallel lugs 30 extending from the magazine body tightly fit under a pair of corresponding overhanging lugs 32 extending from the base housing, thereby firmly securing the magazine at the loading end. It will he appreciated that the magazine must first be pressed in under the overhanging lugs 32, then the latching device engaged by pressing down.

When the magazine 16 is in its normal operative position, as just described, an opening 36 in the side and bottom of magazine body 20 is aligned with a loading hole 42 and matching the abutting wall 44 of the receiving housing 24. Consequently, when the carousel 21 is stepped incrementally, in order to feed pellets sequentially to the gun, the loading hole 42 permits each pellet in turn to be forced into a cross-loading cylinder bore 47.

Disposed below the abutting wall 44 and within the gun structure is a cross-loading cylinder 46 whose purpose is to receive pellets as these are sequentially fed down through the loading hole 42 and to present these to the barrel for firing. This is accomplished by dint of the cam-lever device 48 comprising a lever 50, and integral therewith a cam 52. The cam-lever device 48 is coupled to the loading cylinder 46 by means of an internal tenon or projection 54 which fits into slot 56 of the loading cylinder.

Accordingly, as will be understood from FIGS. 1 and 5, when the cam-lever (shown dotted in some figures) has been activated such that it is in the horizontal position seen, this corresponds to the firing position for the loading cylinder 46, whereby a pellet already received in the bore 47 within such cylinder is placed in the appropriate horizontal position.

On the other hand, as will be understood from FIG. 6, the loading position corresponds to the cam-lever device 48 having been put in such a position that the lever is oriented vertically (moving counter-clockwise), whereby a pellet can then be pushed down into the loading cylinder bore 47 from above.

Figure 3:
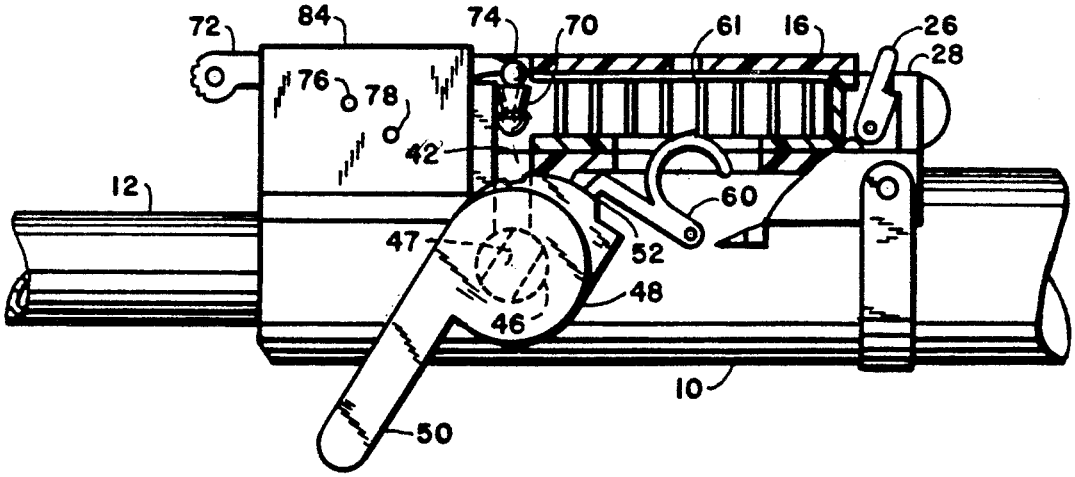
FIG. 3 is another fragmentary view of the system similar to FIG. 2 but showing the cam-lever and advancing finger, with its lever having been rotated approximately 45 degrees in the counter-clockwise direction so as to change the positioning of the loading cylinder.
Figure 4:
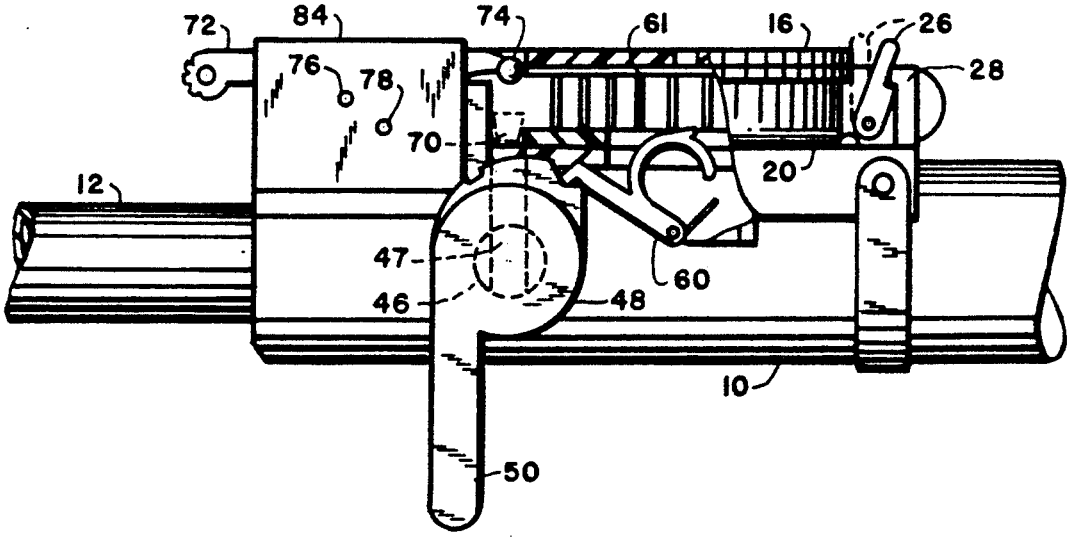
FIG. 4 is another fragmentary view of the system similar to FIG. 3, but wherein the cam-lever has been rotated further counterclockwise to 90 degrees from the original position in FIG. 2 so that a given pellet can be loaded into the loading cylinder bore.

The cam-lever device 48 is also operative to cause the advancing finger 60 to move at appropriate times. Thus, as the cam-lever device is rotated from the horizontal position for the lever 50 to the vertical position (FIGS. 3 and 4), the cam 52 will cause the finger 60, whose upper part extends through opening 62 in the base member 24, to produce incremental rotational advancement of the carousel 20 within the magazine 16, by engaging and pushing the underside of the inner row of partitions 61 shown (FIG. 3). As the carousel is moved, detent means 35 on body 20 allows only one direction of rotation for the carousel.

The significant advantage of positive insertion and sizing of each of the pellets is accomplished by the interrelationship of the already described components. In particular, the pellet setting device 34 as particularly shown in FIGS. 1, 5, 6, and 7 enables more uniform and accurate travel of the projectile because it forces a given pellet 70 into the opening or bore 47 of the loading cylinder 46 so as to properly size all pellet skirts, whether they have been deformed or not. This will be appreciated from the construction to be described.

The pellet setting device 34 comprises an arm 72 having a ball-like end portion 74, the arm being multiply-pivoted. The arm is retained in links 80 and 82 by suitable means such as rivets 73 and 75 and the links, in turn, are pivotally mounted in vertical walls 84 of the base housing 24 by rivets 76 and 78 respectively.

It will thus be understood that the arm 72 is enabled to pivot such that the ball-like end 74 describes approximately a straight line from its rest position towards the loading cylinder below. Hence, it applies the required force directly against a given pellet 70 as that pellet is being pushed into the bore 47 of loading cylinder 46. This insures that the pellets are forced into the bore 47. See especially FIGS. 6 and 7, in which the contact of the ball-like end portion 74 with the top of the pellet can be appreciated. In accomplishing this desirable result, all that is required is a simple manipulation by the user of the arm 72; that is, applying rotating force to the left end of arm 72.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

I claim:

1. A pellet feeding system for an air gun having a loading cylinder, comprising:

a magazine removably attached to said gun, said magazine having a carousel formed with a plurality of compartments dimensioned to permit the containment of pellets having a variety of shapes;

means for incrementally rotating said carousel to position the carousel for loading said pellets singly into the loading cylinder and for rotating said loading cylinder to receive said pellets singly;

a pellet setting device mounted adjacent to and cooperating with said magazine to advance the pellets singly down into said loading cylinder so that the skirt of an advanced pellet is sized within the bore diameter of said loading cylinder.

2. A system as defined in claim 1, further comprising a receiver housing on said gun, said pellet setting device being mounted on said housing.

3. A device as defined in claim 2, in which said gun is provided with a loading hole, and the carousel inside the magazine positions a pellet directly over a loading hole in the receiver housing, which is directly over said loading hole in the gun.

4. A device as defined in claim 2, in which the magazine is retained by a latching means on said magazine, for engaging a lug and guides on said receiver housing.

5. A system as defined in claim 1, further comprising hand actuatable means for concurrently effectuating both rotation of said carousel within said magazine and rotation of said loading cylinder.

6. A system as defined in claim 1, in which said magazine further includes a cover, a body having a central boss and a detent means engaging said boss.

7. A device as defined in claim 1, in which pellets having a variety of shapes are loaded within said removable magazine before attaching said magazine to said gun, all said shapes having a common diameter.

8. A system as defined in claim 1, in which said pellet setting device includes an arm, and a multiple linkage for effectuating movement of one end of said arm in an almost straight vertical line such that a pellet is forcefully loaded into said loading cylinder.

9. A system as defined in claim 1, in which said means for incrementally rotating said carousel includes a cam-lever means, and a finger actuatable by said cam-lever for selectively engaging spaced portions of said carousel.

10. A magazine adapted to be attached to a receiving housing on an air gun, said magazine comprising:

a magazine body and a cover;

a carousel rotatably mounted within said body and formed with a plurality of compartments dimensioned to permit the containment of respective pellets having a variety of shapes with a common diameter; and latching means for removably latching said magazine body against rotation on the receiving housing of said gun, said latching means comprising upstanding guides and an upstanding lug spaced longitudinally from said guides, both said guides and said lug being integrally formed on said receiving housing, and a latching device integrally formed and mounted between parallel walls on said magazine body, said latching device being operative when pressed down, as said magazine is secured in position, for engaging with said lug.

11. A magazine as defined in claim 10, further including a cover and a magazine body, said body having a central boss, and a detent means engaging said body for allowing only one direction of rotation for said carousel.

* * * * *